US008205369B2

(12) United States Patent
Pemberton

(10) Patent No.: US 8,205,369 B2
(45) **Date of Patent: *Jun. 26, 2012**

(54) SIGNAGE APPARATUS HAVING SIMPLE MAGNET-BASED STRUCTURE FOR EASE OF MODIFICATION

(76) Inventor: Kirk Pemberton, Gardena, CA (US)

( * ) Notice: Subject to any disclaimer, the term of this patent is extended or adjusted under 35 U.S.C. 154(b) by 147 days.

This patent is subject to a terminal disclaimer.

(21) Appl. No.: 12/460,570

(22) Filed: Jul. 21, 2009

(65) Prior Publication Data

US 2010/0024266 A1 Feb. 4, 2010

Related U.S. Application Data

(63) Continuation-in-part of application No. 11/653,063, filed on Jan. 12, 2007, now Pat. No. 7,870,687.

(51) Int. Cl.
*G09F 7/04* (2006.01)

(52) U.S. Cl. ..... 40/600; 40/576

(58) Field of Classification Search ..... 40/600, 40/661.01, 568, 575, 576, 711
See application file for complete search history.

(56) References Cited

U.S. PATENT DOCUMENTS 3,965,599 A * 6/1976 Ebner ..... 40/711
4,475,300 A * 10/1984 Ledenican ..... 40/600
5,172,503 A * 12/1992 Dane et al. ..... 40/600
5,502,907 A * 4/1996 Wang ..... 40/711
5,901,486 A * 5/1999 Sharon et al. ..... 40/618
6,282,825 B1 * 9/2001 Godfrey et al. ..... 40/611.01
6,298,591 B1 * 10/2001 Healy ..... 40/600
6,631,576 B2 * 10/2003 Hillstrom ..... 40/574
7,870,687 B2 * 1/2011 Pemberton ..... 40/568
2005/0005489 A1 * 1/2005 Ridenour et al. ..... 40/600
2006/0117617 A1 * 6/2006 Peterson et al. ..... 40/1.6
2007/0204500 A1 * 9/2007 Splittgerber ..... 40/781

* cited by examiner

*Primary Examiner* — Gary Hoge
(74) *Attorney, Agent, or Firm* — Leonard Tachner

(57) ABSTRACT

A modifiable modular sign apparatus is especially useful for fast food restaurants as backlighted menu boards. The apparatus comprises a translucent substrate board which is planar and has a front surface and a back surface. Precisely positioned holes are prepared at selected locations. These holes are aligned with thin metal shims which are affixed on the back surface of the mounting board and receive cylindrical magnets. In one embodiment the magnets are attached directly to the rear of printed sheet. In a second embodiment, magnets are positioned in the mounting board holes adhesively secured to the shims. Each printed sheet has a plurality of snap-caps extending through respective holes. The board side end of each snap-cap has a metal member for being magnetically affixed to a magnet in the mounting board hole. The printed sheet may be provided with price carriers to permit personnel to change prices.

16 Claims, 14 Drawing Sheets

SIGNAGE APPARATUS HAVING SIMPLE MAGNET-BASED STRUCTURE FOR EASE OF MODIFICATION

CROSS-REFERENCE TO RELATED APPLICATIONS

This application is a continuation-in-part of patent application Ser. No. 11/653,063 filed on Jan. 12, 2007 now U.S. Pat. No. 7,870,687.

BACKGROUND OF THE INVENTION

1. Field of the Invention

The present invention relates generally to signs of the type used in fast food restaurants, coffee shops and other retail stores where items offered for sale and their prices frequently change. More specifically, the invention herein relates to a readily modifiable menu board or similar sign which employs a relatively simple magnet-based structure to facilitate easy modifications by non-technical personnel.

2. Background Art

Modular panel signs are most commonly found in fast food restaurants for display of their food menu in both outdoor and indoor applications. Such signs are usually backlighted and often contain verbal and graphical descriptions of food items and their respective retail prices. One of the key attributes of such menu signs is that they're usually the best and often the only source of menu information for the retail consumer in the restaurant or in the drive-through lane of the restaurant. Therefore, such signs are of critical importance to the successful operation of the restaurant. Their price information is very important as is their graphics which may both provide information about and entice the prospective fast food consumer to purchase a particular food item based on its visual appearance. A common characteristic of restaurants and other food-oriented retail establishments, particularly fast food stores, is that their menu changes often. Either the food items or the respective prices for food items or both, will change frequently to accommodate new offerings, delete less popular items and reflect virtually constantly revised prices to respond to competition or to comport with media advertising. For this reason, it is important that signs are relatively easy to update frequently and that signs can be modified by unsophisticated personnel without requiring elaborate and expensive training.

Issued U.S. Pat. Nos. 6,003,258 and 6,282,825 to Godfrey et al disclose one prior art sign assembly which addresses the need for a menu board type display which can be modified to other content including price information. The sign assembly of the Godfrey et al patents comprises a frame design having distinct front and rear portions as shown, for example, in their FIG. 6. The rear portion comprises a frame and the front portion comprises a mechanically mating transparent cover panel which holds a plastic sheet and a sign element which has graphics printed thereon. The cover panel uses magnetic strips to adhere to the frame at mating metallic strips which are adhesively secured to the frame at matching locations. Separate retention members and stop elements are employed to prevent the sign from sliding out of position. The sign element may be in the form of elongated strips as shown in their FIG. 21. Each such strip is disclosed as having a front piece and a back piece. The front piece has a number of rectangular windows and the back piece has a corresponding number of aligned price pockets for holding inserted numerical indicia for displaying price information through the windows of the front piece. The front piece also has alphanumeric characters which may be printed thereon.

Another readily modified sign assembly for similar applications is disclosed in U.S. Pat. No. 6,182,387 to Duguay. This patent discloses a sign assembly having a magnetically attractable uniform surface completely covered by individual magnetic strips and price elements. Each such strip or element comprises a solid front surface bearing printed indicia and a magnet or magnetic strip affixed to the rear of the front surface. The magnet covers only a portion of the rear of the front surface so that a fulcrum point is formed to permit removal and replacement of the element or strip without special tools. A problem with such a sign assembly is that such a large plurality of separate sign elements do not provide a uniform and professional-looking appearance. Additionally, even with relatively strong magnets, the individual elements would tend to slide off of their intended positions.

Although the prior art disclosures address the need for a sign assembly that can be modified to accommodate frequent changes in food items and their respective prices, there are a number of disadvantages which remain. For example, the number of steps required to change a display are still greater than is desired. The structural complexity of the assembly is still higher than is preferred. The use of a frame of a particular size would make it disadvantageous to change the dimensions of the preferred sign graphics. The use of price pockets on a back piece that need to extend through aligned windows on a front piece, put undesirable constraints on the dimensions and manufacture of the signs and make the price pocket concept unnecessarily complex. The need for locking or stop elements to prevent sliding movement of the printed sign element within the assembled frame is also a disadvantage because it adds to the parts count and cost of the assembly. Moreover, a sign having a large number of individual magnetic pieces does not present a professional finished appearance.

Therefore, there is still an unresolved need for a readily modified signage apparatus which overcomes the noted deficiencies of the prior art. More specifically, it would be highly advantageous if there were a sign assembly which did not require a frame structure, which did not need separate locking or stop elements, which did not utilize separate front and back pieces for price pockets, which was of even simpler structure, which required even fewer steps to change sign content and which still provided a neat, finished and professional looking appearance.

SUMMARY OF THE INVENTION

The present invention, in its preferred embodiment, provides a simple and advantageous solution for the previously unresolved need for a readily modifiable modular sign apparatus that is especially useful for fast food restaurants as backlighted menu boards in both indoor and outdoor applications. The apparatus comprises a preferably translucent substrate or mounting board which may be made of an acrylic or other rigid material including, for example, polycarbonate or styrene. The mounting board is preferably planar and has a front surface and a back surface and in a preferred embodiment is about 5 mm in thickness. Precisely positioned holes are prepared at selected locations. These holes are formed to be aligned with thin metal shims which are affixed on the back surface of the mounting board and receive cylindrical magnets on the front surface. In one embodiment the magnets are attached directly to the rear of printed sheets, each of which may have wording or pictorial information or both. The magnets contact the metal shims through the mounting board holes, and are held firmly in position by virtue of both the magnetic attractive force and the shape of the walls of the mounting board holes. The mounting board holes are preferably beveled toward the front surface of the board to make it easier to locate the magnets accurately and to remove them when it is desired to replace the printed sheet.

The printed sheets have precise, selected dimensions to fill a desired space on the substrate or mounting board, while at the same time, having one or more edges which closely align with one or more corresponding edges or borders of the mounting board. For example, where a printed sheet is rectangular in shape, its upper edge may be substantially congruent to the upper edge of the mounting board. This alignment precision is dependent on the location of the holes and metal shims on the mounting board and on the accuracy of placement of the magnets that are affixed on the back surface of the printed sheets.

Changing the content of a sign of the present invention, involves the simple steps of removing a sheet by pulling the sheet and its adhered magnets away the mounting board and replacing it with another printed sheet having magnets which mate with the mounting board holes. Border or edge members made of plastic or other inexpensive materials, may be preferably used between adjacent printed sheets to provide a neat finished appearance. Such border members may be secured to the mounting board using holes and metal shims and adhered magnets in the same manner as the printed sheets are secured.

In a second embodiment, small magnets are affixed directly to the metal shims, each such magnet being adhesively secured to one such shim within a mounting board hole. Each printed sheet in this embodiment has a plurality of snap-caps, preferably one snap-cap at each corner of the sheet. Each snap-cap extends through a small aperture in the sheet. The end of the snap-cap on the inner or back surface of the sheet has a metal member of a size to mate with a corresponding magnet in the mounting board hole to which the snap-cap is aligned. The front of the snap-cap has a circular plastic flange securing the front surface of the sheet.

The printed sheets may be provided with price carriers to permit personnel to change just food prices without the requirement to replace the entire printed sheet. In the preferred embodiment of the present invention, such price carriers are affixed directly to the front surface of the printed sheets in a unitary, integrated structure that provides easy access to the price indicia. In the preferred embodiment, the price carriers are injection-molded plastic parts.

The mounting board may be provided with a large number of extra holes with affixed metal shims so that the size and shape of the printed sheets may be altered as well, by simply adjusting the locations of the affixed magnets or the snap-caps on the replacement sheets. This feature provides the added flexibility of changing the module geometry of a modular sign assembly without replacing the mounting board.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which:

FIG. 4, comprising

FIG. 5, comprising

FIG. 6, comprising

DETAILED DESCRIPTION OF A PREFERRED EMBODIMENT

Figure 1:
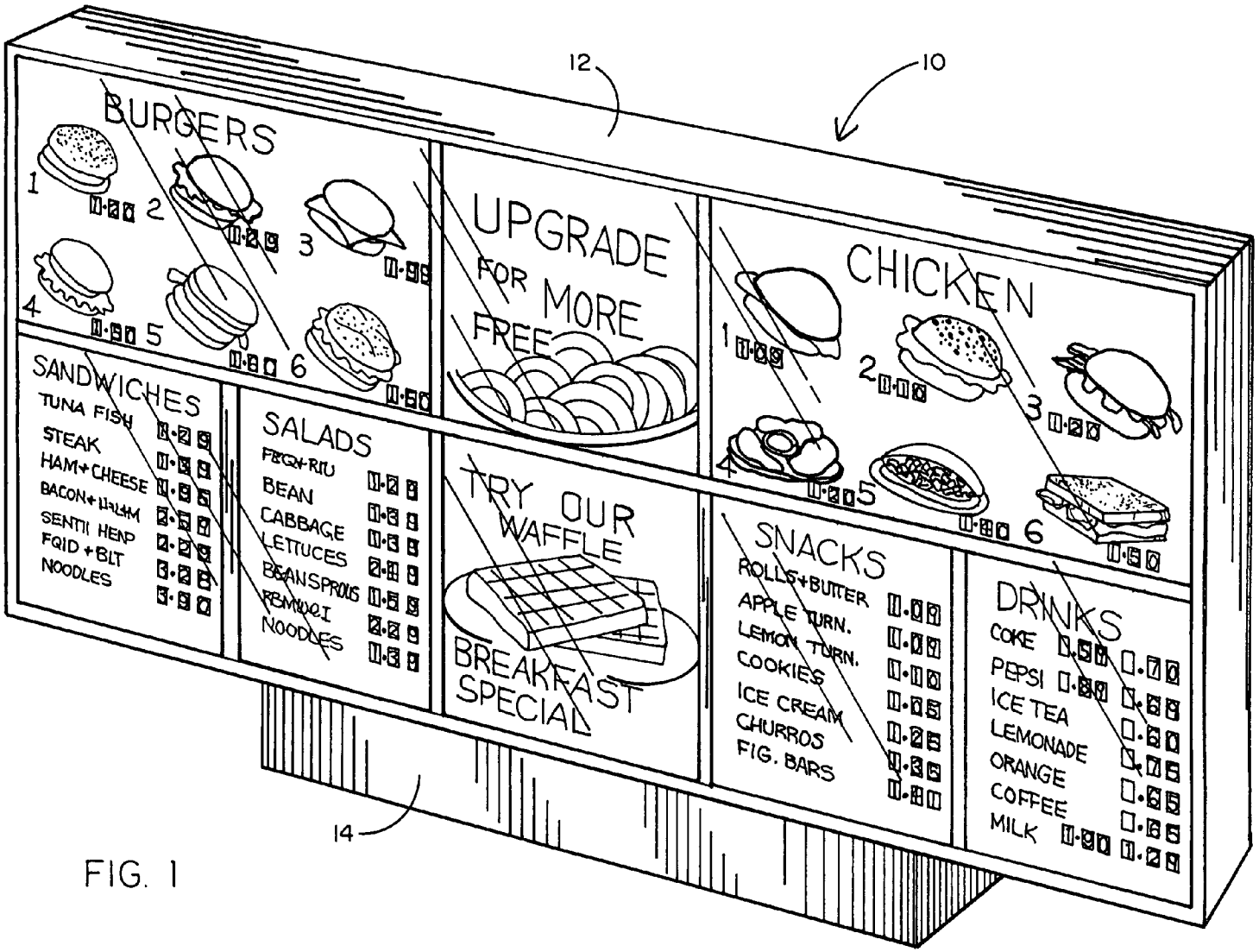
FIG. 1 is a three-dimensional view of a fast food outdoor modular, backlighted sign display in which the preferred embodiments of the invention are employed.
Figure 2:
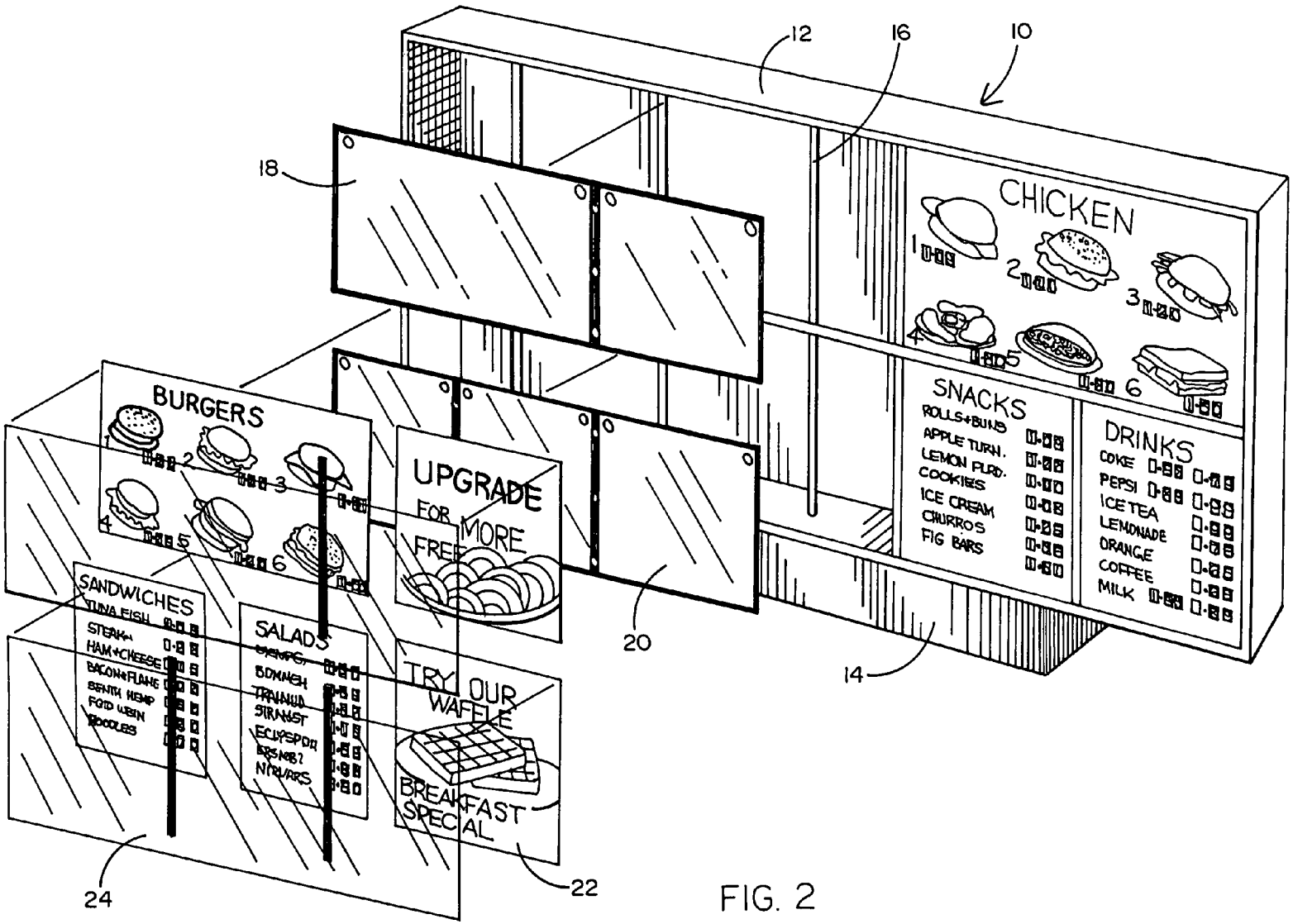
FIG. 2 is a partially exploded view of the sign display of FIG. 1.
Figure 3:
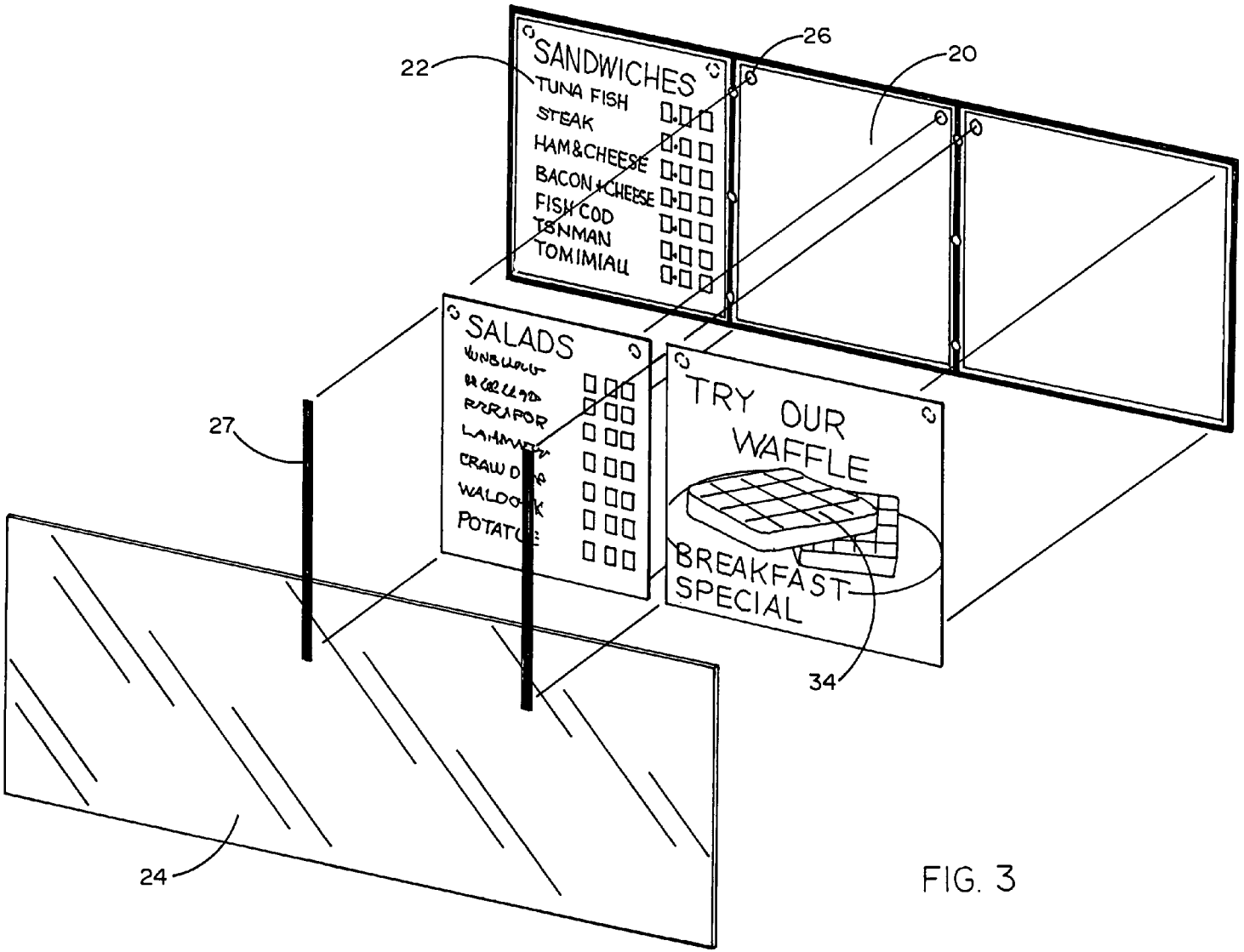
FIG. 3 is a further enlarged and exploded view of a selected module of the sign display of FIG. 1.

Referring to the accompanying drawings and initially to FIGS. 1-3, it will be seen that a modular display 10 comprises a rectangular enclosure 12 resting on a base 14. The enclosure 12 has a plurality of backlights 16 in the form of vertical fluorescent tubes. A plurality of rectangular mounting boards 18, 19, 20 and 21 are positioned in front of the backlights 16. Each such mounting board is covered by one or more printed sheets 22. A transparent hard plastic protective cover 24 overlies the printed sheets. Between each pair of adjacent printed sheets 22 is an edge member 27.

Figure 4A:
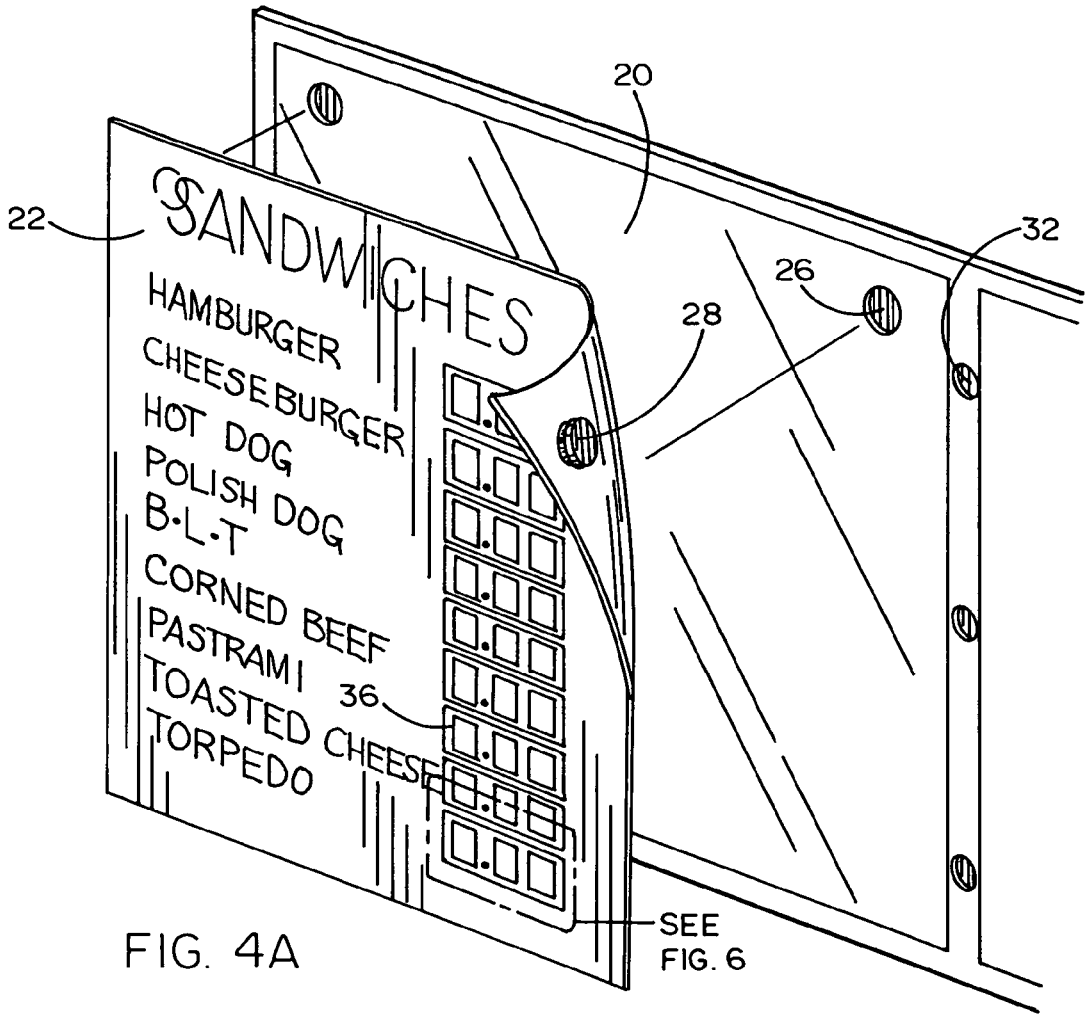
FIGS. 4A, 4B and 4C, is a still further enlarged view of a portion of a selected module of the sign display of FIG. 3 and illustrating the first embodiment thereof.
Figure 4B:
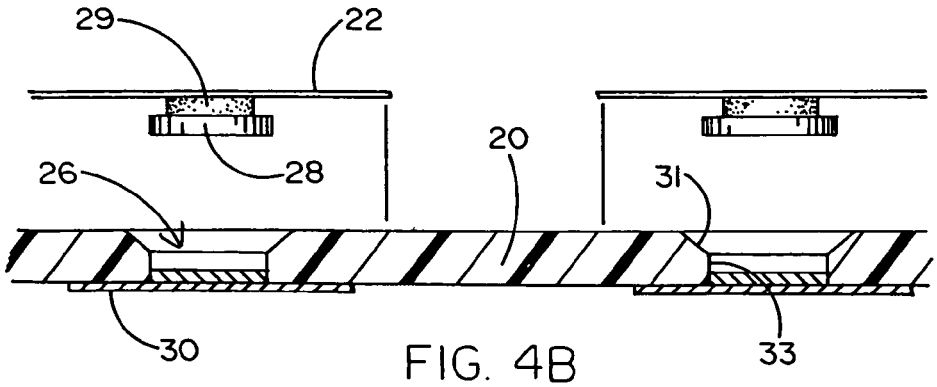
Figure 4C:
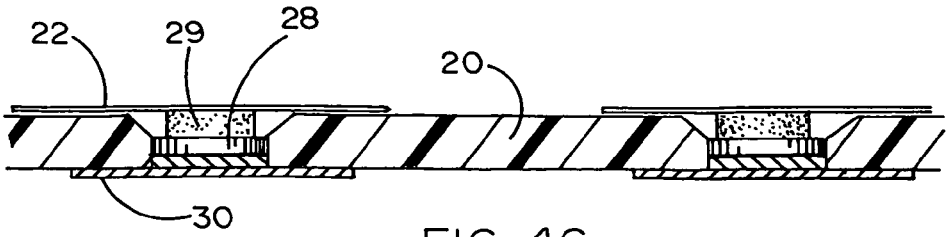

The manner in which the printed sheets and edge members are secured to the mounting board is shown in FIGS. 4 and 5. Referring first to FIG. 4, it will be seen that each printed sheet 22 is attached to the mounting board at a pair of apertures 26 using a corresponding pair of flat cylindrical magnets 28. Each such magnet is adhesively affixed to a sponge-like material 29 which is, in turn, glued to the back of the printed sheet 22 at precisely selected locations. As shown best in FIGS. 4B and 4C, the back surface of the mounting board has a round metal shim 30 aligned with each aperture 26 and adhered to the mounting board surface. Each such aperture 26 has a beveled front portion 31 and straight-walled portion 33. The magnets 28, each extend through the beveled portion 31 and rest in the straight-walled portion 33 where it contacts the metal shim 30.

Figure 5A:
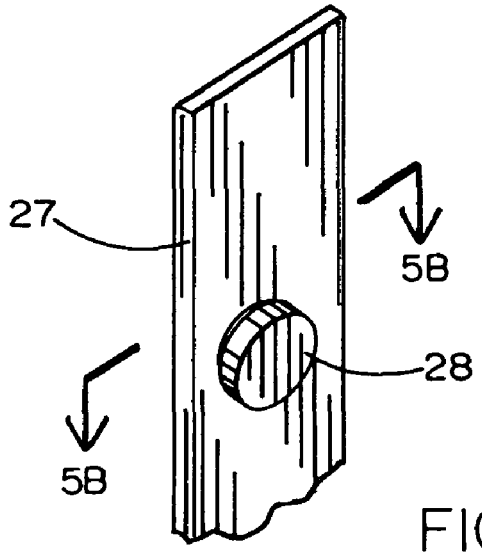
FIGS. 5A, 5B and 5C, is a view of an edge member used in the preferred embodiment.
Figure 5B:
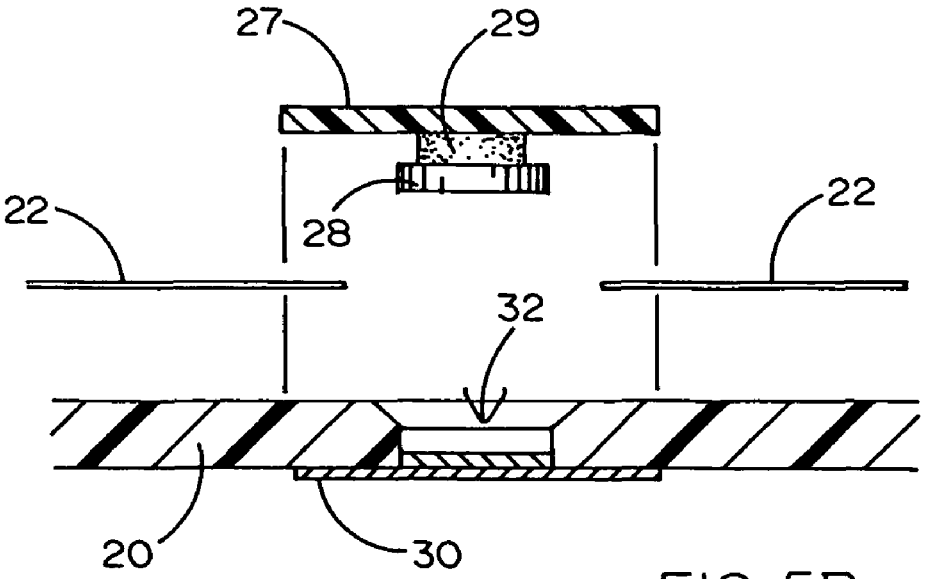
Figure 5C:
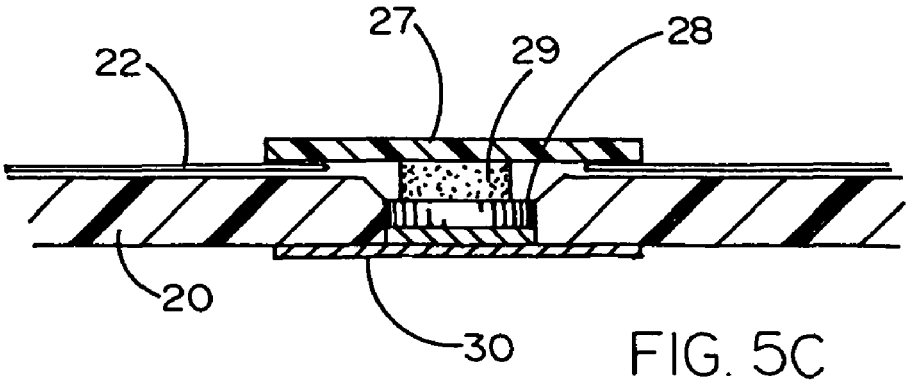
Figure 8:
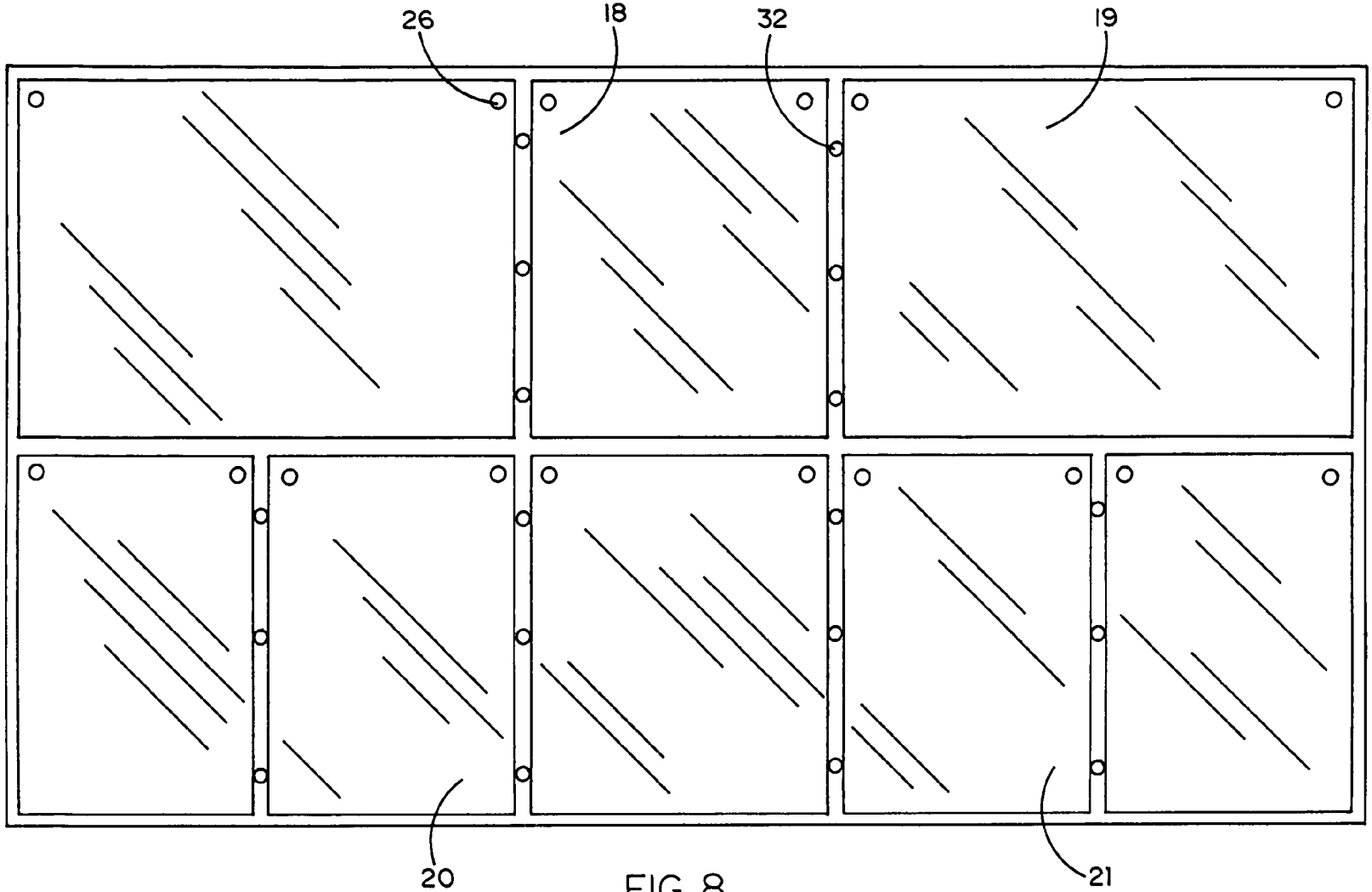
FIG. 8 is a plan view of a mounting board assembly of the sign display of FIG. 1.

As shown in FIGS. 5A, 5B and 5C, each edge member 27 is connected using a plurality of the magnets 28 in mounting board apertures 32. Each such aperture 32 has the same structure (i.e. partially beveled, partially straight) as the aperture 26 and also terminates in a round metal shim 30. The edge members 27 preferably overlap the adjacent edges of two sheets 22 to provide a finished, neat look to the display. The relative positions of the mounting boards 18, 19, 20 and 21 and their respective apertures 26 and 32 are shown in FIG. 8 for the entire modular display 10.

Figure 6A:
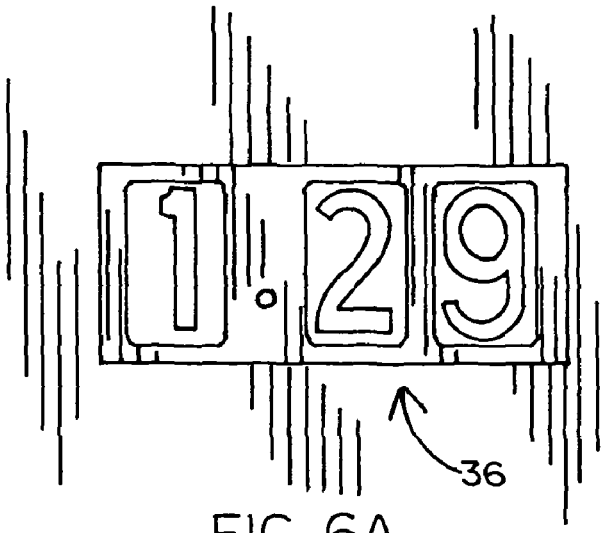
FIGS. 6A, 6B and 6C, is a view of a price carrier construction of a first embodiment.
Figure 6B:
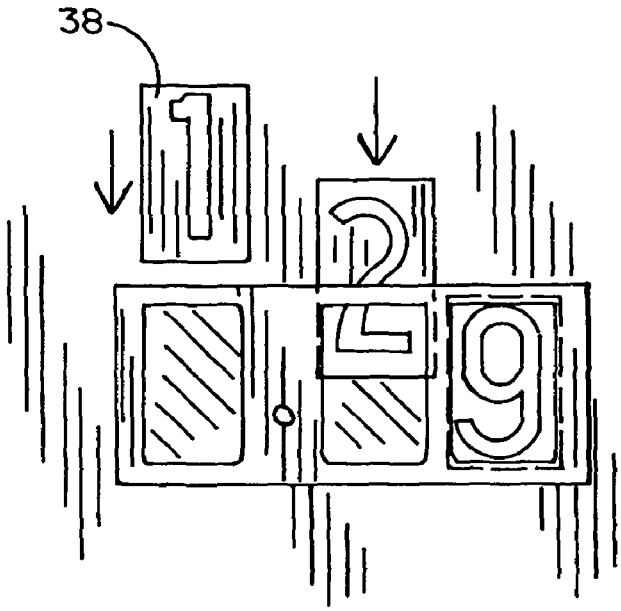
Figure 6C:
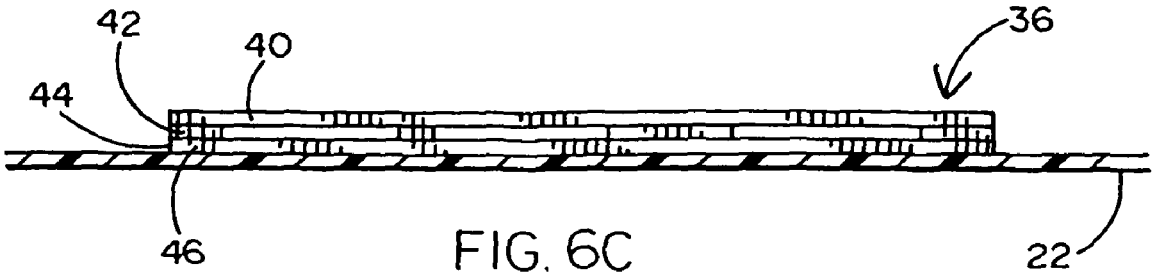
Figure 7:
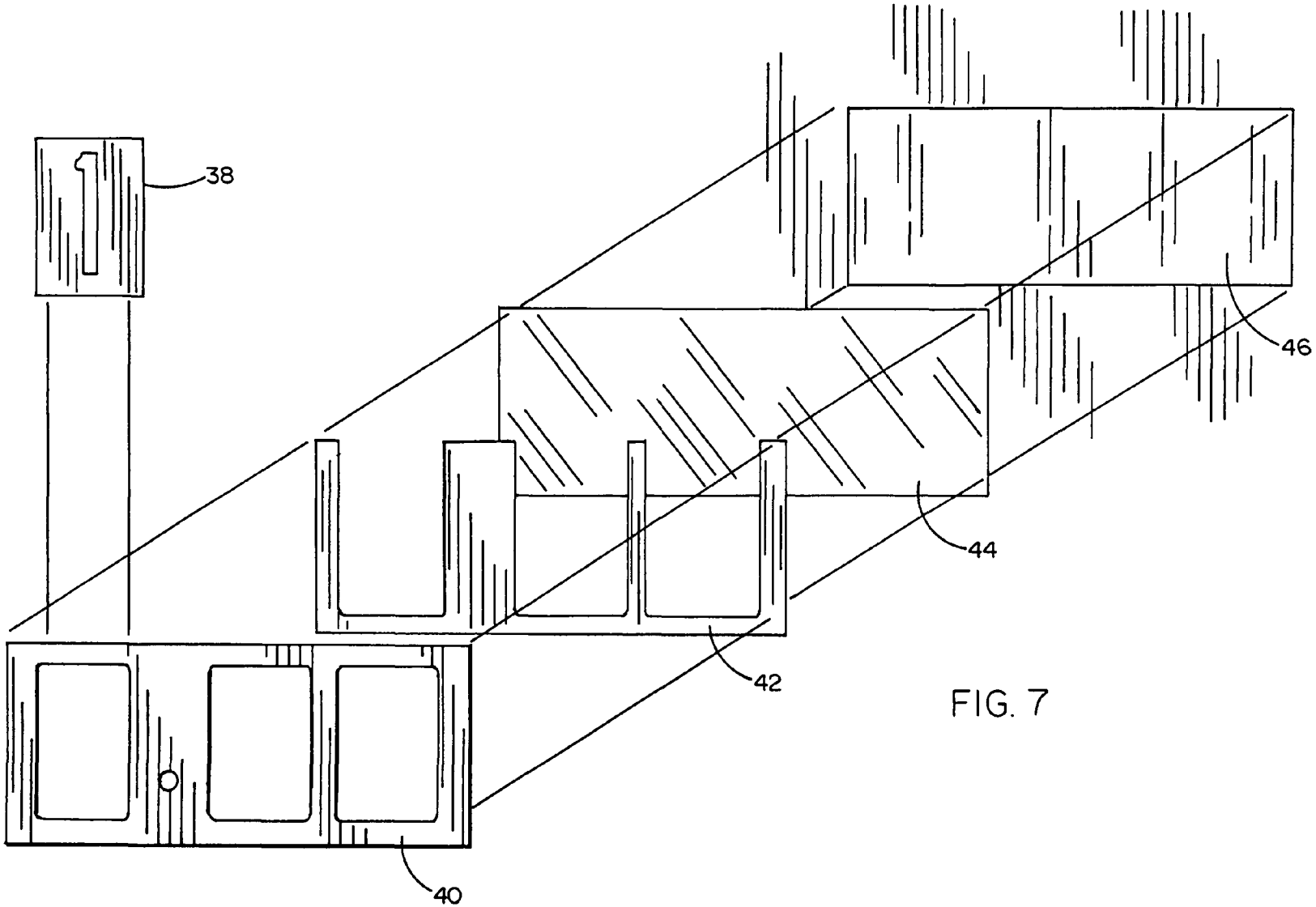
FIG. 7 is an exploded view of the price carrier of FIG. 6.

As seen in FIGS. 3 and 4A, some of the printed sheets 22 may have graphics 34 and/or wording 35 as well as price carriers 36. Price carriers permit price changes to be made without replacing the sheets. Their structure is shown in FIGS. 6A, 6B, 6C and 7. As shown in those figures, a price carrier 36 according to a preferred embodiment of the present invention, comprises at least one number sheet 38, a window member 40, a number sheet holder 42, a slip member 44 and a backing 46. These constituent parts are adhesively assembled as shown in FIG. 7 and then secured to the front surface of a printed sheet 22 as shown in FIG. 6C. The number sheets 38, reflecting the current price of a product, are then inserted as shown in FIG. 6B to provide a selected price as shown in FIG. 6A.

Figure 9:
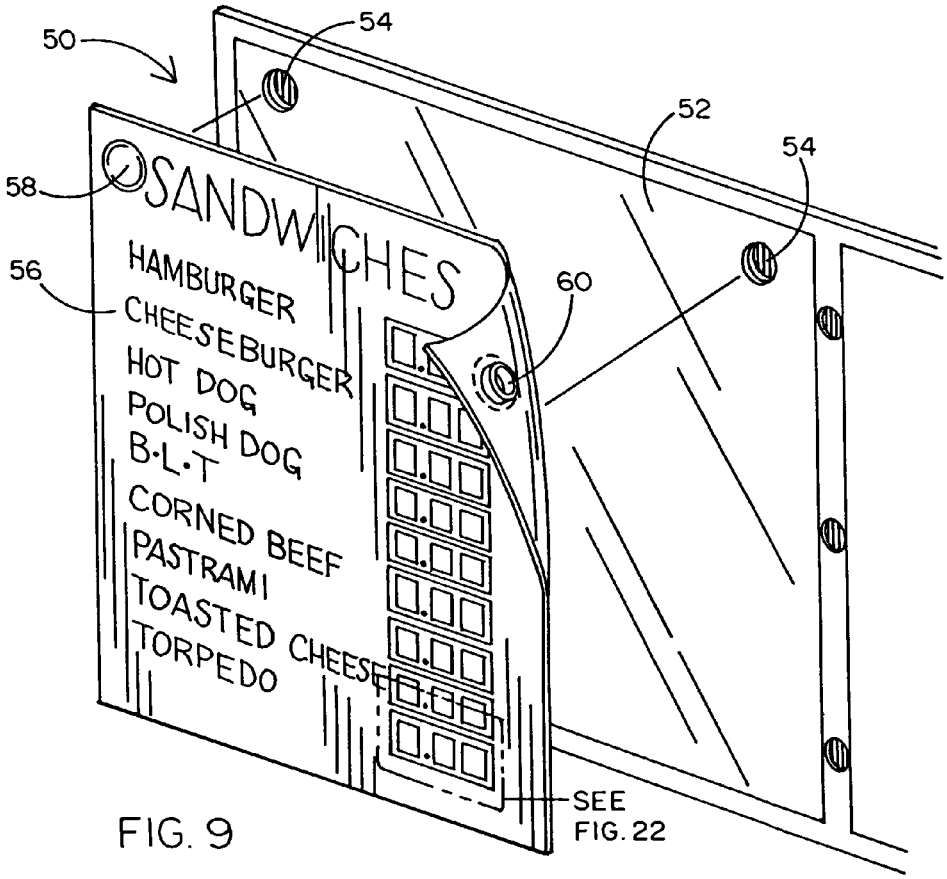
FIG. 9 is an exploded view of a second embodiment of the sign display hereof.
Figure 10:
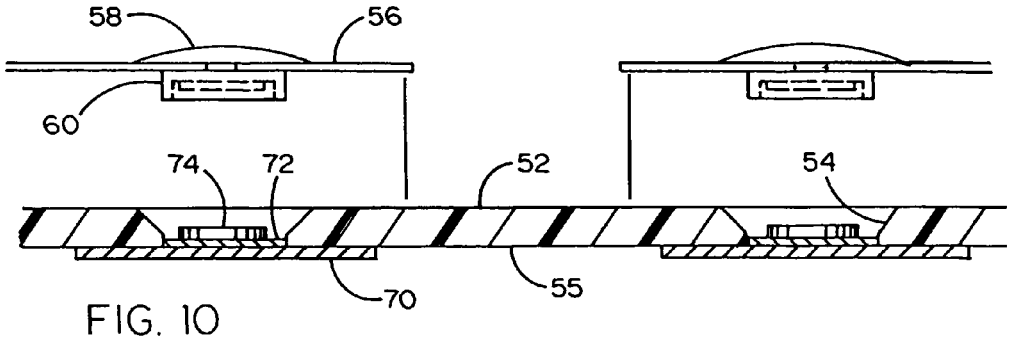
FIG. 10 is a first cross-sectional view of the embodiment of FIG. 9.

Reference will now be made to FIGS. 9 to 20 which illustrate an alternative preferred embodiment of the invention for affixing graphics sheets to a mounting board. As shown in FIG. 9, in an embodiment 50, a mounting board 52 has a plurality of bezel apertures 54 for receiving at least one graphics sheet 56 to form a menu board. As seen best in FIGS. 10 and 11, in this embodiment a metal shim 70 is secured to the back surface 55 of the board adjacent each aperture 54 and a round metal projection 72 extends into the aperture. A watch battery size magnet 74 is secured to the projection 72 by an adhesive.

Figure 11:
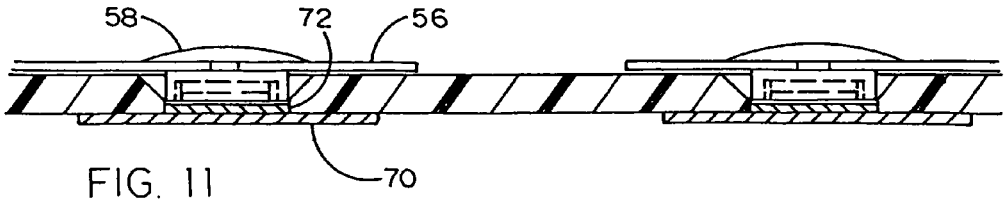
FIG. 11 is a second cross-sectional view of the embodiment of FIG. 9.
Figure 13:
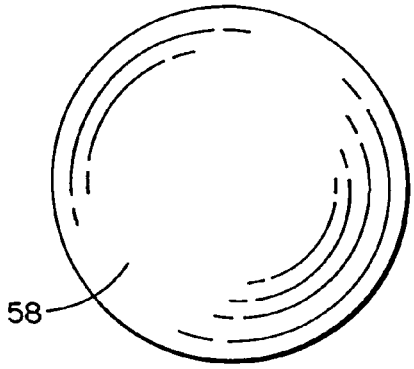
FIG. 13 is another view of the top of the snap-cap of FIG. 12.
Figure 14:
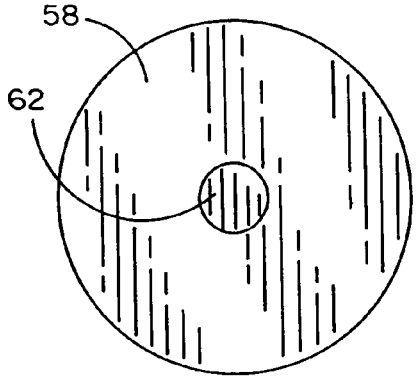
FIG. 14 is an inner view of the snap-cap top of FIG. 12.
Figure 12:
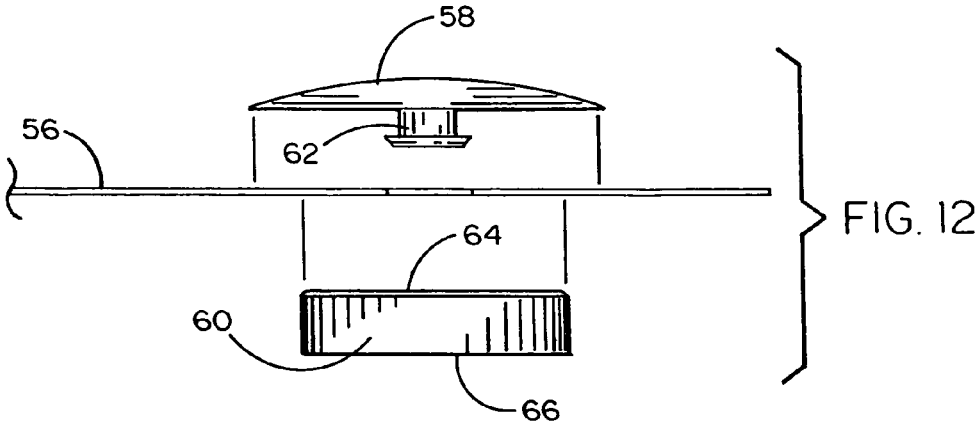
FIG. 12 is a top view of a snap-cap upper attachment to a graphics sheet in the second embodiment of the invention.
Figure 15:
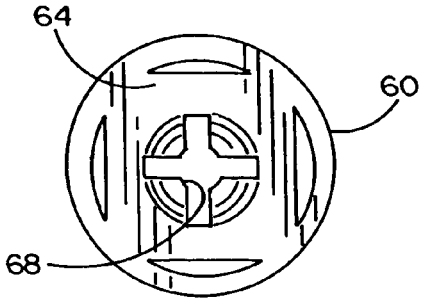
FIGS. 15 to 17 are top, bottom and cross-sectional views, respectively of the snap-cap lower attachment to a graphics sheet.
Figure 16:
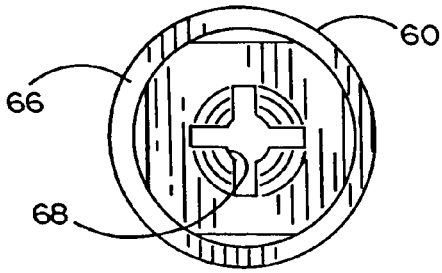
Figure 17:
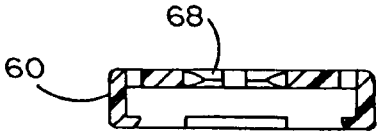
Figure 19:
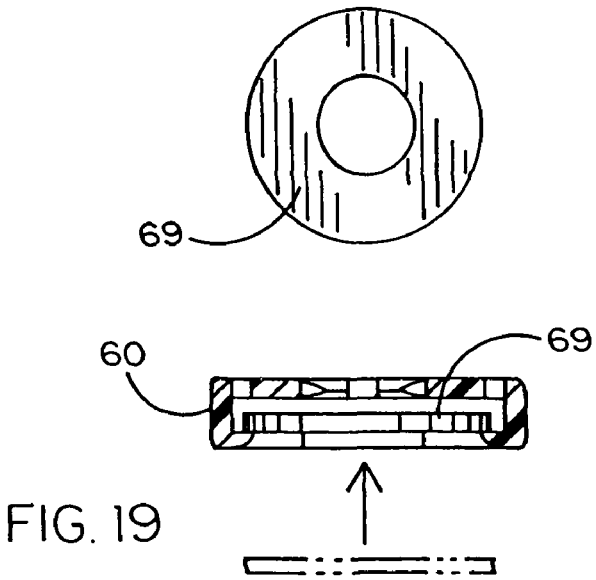
FIG. 19 is an exploded cross-sectional view of the lower snap-cap attachment.
Figure 18:
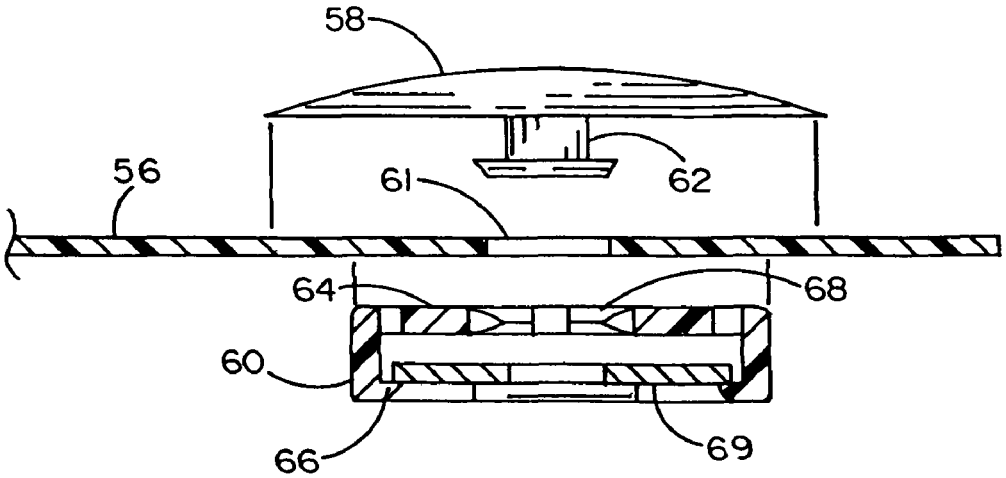
FIG. 18 is an exploded cross-sectional view of the snap-cap of FIG. 12.
Figure 20:
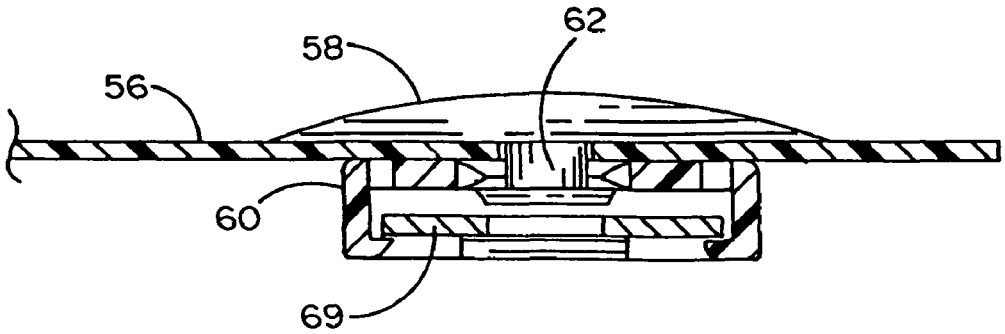
FIG. 20 is an assembled view of the snap-cap.

At respective corners of the graphics sheet 56 are mounted snap-cap connections 58. Each has a center protrusion 62 which extends through a small hole 61 in the sheet 56 and mates with a disk 60. Disk 60 has a sheet side surface 64 and a board side surface 66 as seen in FIG. 12. Protrusion 62 is lockably received in a mating member 68 (see FIGS. 15 to 17). As shown in FIGS. 18 to 20, disk 60 has a metal washer 69 secured therein and when mated with snap-cap connection 58 by trapping protrusion 62, sandwiches the graphic sheet 56 as best shown in FIG. 20. This permits washer 69 to be magnetically affixed to magnet 74 as shown in FIG. 11. Thus, in this second embodiment, each graphics sheet 56 is secured to mounting board 52 by a plurality of magnets, but those magnets remain in the apertures 54 of the board instead of on the back of the sheets as depicted in the first embodiment of FIG. 4A-4C.

Figure 21:
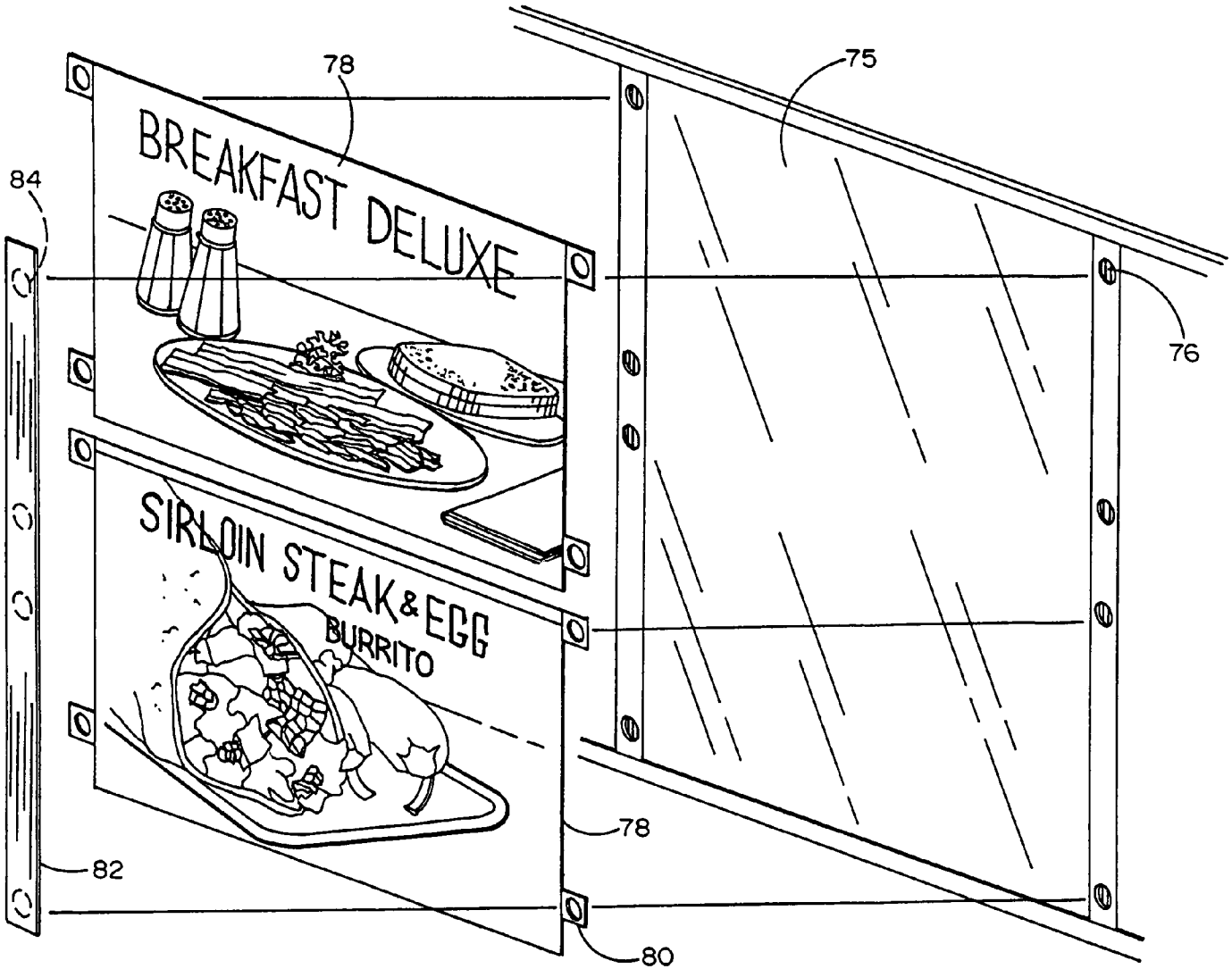
FIG. 21 is an exploded view of a split graphics configuration of the invention.
Figure 22:
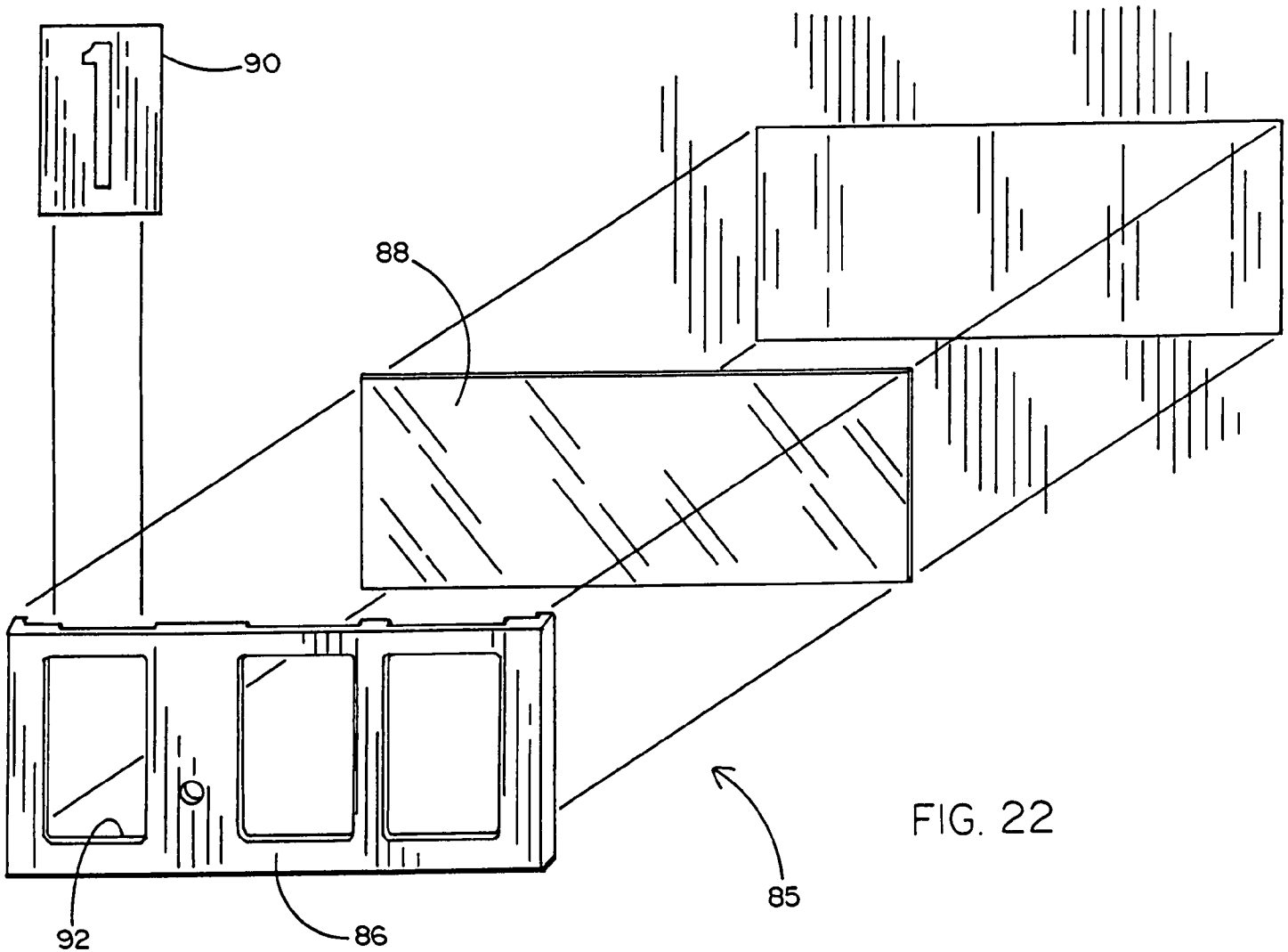
FIG. 22 is an exploded view of a second embodiment of a price carrier of the invention.
Figure 23:
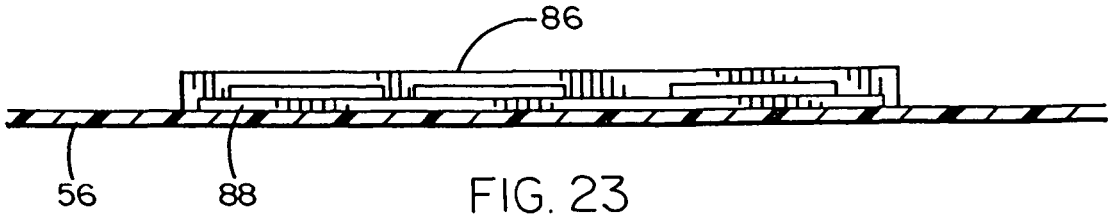
FIG. 23 is a top view of the carrier of FIG. 22.
Figure 24:
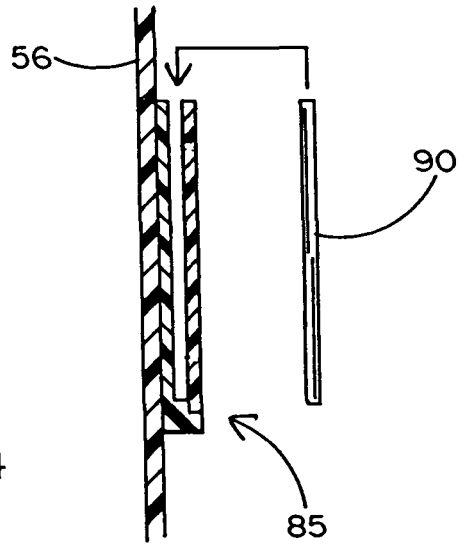
FIG. 24 is a side cross-sectional view of the carrier of FIG. 22.
Figure 25:
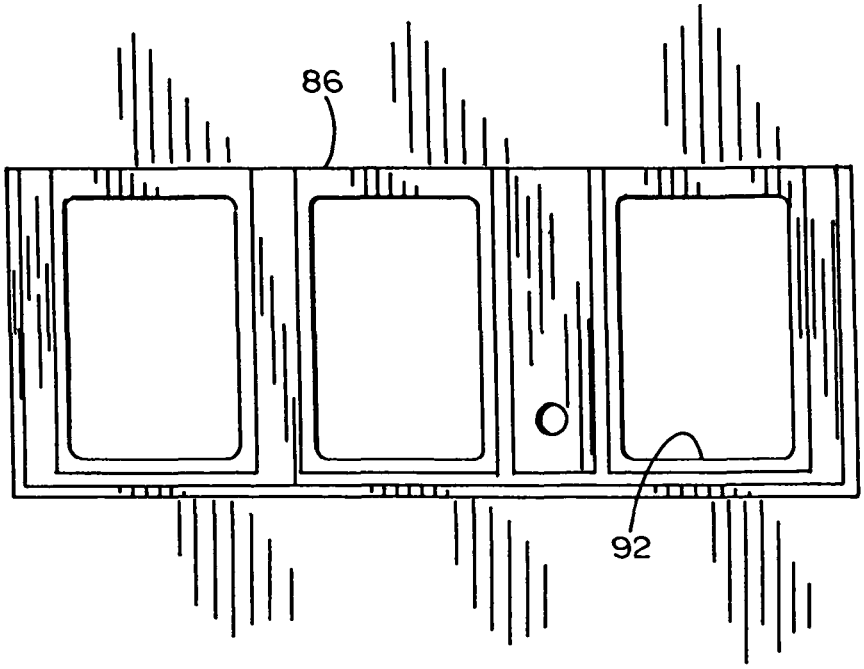
FIG. 25 is a rear view of the injection-molded component of the carrier of FIG. 22.

Another aspect of the invention is shown in FIG. 21 wherein a portion of a mounting board 75 may receive a graphics sheet split into discrete upper and lower portions 78. These upper and lower portions each has a plurality of affixed margin tabs 80 which may facilitate attachment to the mounting board using edge members 82 having magnets 84 secured through tabs 80 into board apertures 76. Their common edges may overlap with the outer overlapping edge being adhesively affixed to the inner underlying edge.

A second price carrier embodiment is also shown in the accompanying figures in FIGS. 22 to 25. This embodiment is a simpler injection-molded version of the price carrier embodiment of FIGS. 6A, 6B, 6C and 7. Price carrier 85 comprises an injection-molded plastic component 86 having a plurality of windows 92 for receiving number sheets 90. A single backing sheet member 88 completes the carrier 85. As seen best in FIGS. 23 and 24, because of the built-in shaping of the injection-molded plastic component 86, carrier 85 is greatly simplified for receiving price sheets or other forms of indicia. Even though such carriers are referred to herein as "price" carriers, it will be apparent that other forms of information such as dates, interest rates, exchange rates, et cetera can also be accommodated.

Having thus disclosed preferred embodiments of the invention, it will now be understood that various modifications may be made while still utilizing the novel features thereof. By way of example, the precise size, position and shape of printed sheets may be modified. Moreover, the location, shape and number of magnets used to secure the printed sheets to a mounting board may be modified. Therefore, it will be understood that the scope hereof is not limited by the disclosed preferred embodiments, but only by the appended claims and their equivalents.

I claim:

1. A signage apparatus comprising:

a mounting board having at least one aperture;

a metal member attached to a rear surface of said mounting board at said aperture and a magnet attached to said metal member within said aperture;

a first printed sheet having observable indicia thereon;

at least one connection device secured to a surface of said first printed sheet, said device being configured to be received in said at least one aperture and having a magnetizable metal for magnetic attraction to said magnet for retaining said first printed sheet against said mounting board;

wherein said magnet and said at least one aperture are both circular cylindrical in shape and where said circular cylindrical aperture is at least partially beveled.

2. The signage apparatus recited in claim 1 further comprising a second printed sheet having observable indicia thereon that is not identical to said observable indicia on said first printed sheet;

at least one connection device secured to a surface of said second printed sheet, said device being configured to be received in the said at least one aperture and having a magnetizable metal for magnetic attraction to said magnet after removal of said first printed sheet from said mounting board for retaining said second printed sheet against said mounting board in replacement of said first printed sheet.

3. The signage apparatus recited in claim 1 wherein said mounting board is translucent.

4. A signage apparatus comprising:

a mounting board having at least one aperture;

a metal member attached to a rear surface of said mounting board at said aperture and a magnet attached to said metal member within said aperture;

a first printed sheet having observable indicia thereon;

at least one connection device secured to a surface of said first printed sheet, said device being configured to be received in said at least one aperture and having a magnetizable metal for magnetic attraction to said magnet for retaining said first printed sheet against said mounting board;

wherein said first printed sheet comprises a price carrier affixed to a front surface of said printed sheet, said price carrier having at least one externally accessible price pocket in an injection-molded face for receiving a selected price number member in said pocket and for replacing said price number member to correspond to a changed price.

5. A readily modifiable signage apparatus comprising:

a mounting board having a substantially planar surface for receiving a printed sheet thereon;

a plurality of printed sheets for being releasibly affixed to said mounting board, each of said printed sheets and said mounting board having corresponding magnetic attraction devices affixed at selected locations for retaining at least one of said printed sheets on said planar surface in a precisely aligned position and for selective removal of one said printed sheet for replacement by another said printed sheet, said magnetic attraction devices being located within recess holes in said mounting board;

wherein said aperture is beveled adjacent said front surface to facilitate extending each said metallic device into said aperture toward a corresponding magnet in said aperture.

6. The signage apparatus recited in claim 5 wherein said magnetic attraction devices comprise a respective metallic member attached to a rear surface of each said printed sheet and a magnet affixed to said mounting board and accessible from a front surface of said mounting board for magnetic retention of said metallic member.

7. The signage apparatus recited in claim 6 wherein said mounting board comprises at least one aperture extending from said front surface to said rear surface to make said magnet accessible to at least one metallic member on each said printed sheet.

8. The signage apparatus recited in claim 5 wherein said aperture is straight-walled adjacent said rear surface to facilitate retention of each said magnet within said aperture and prevent inadvertent movement of each said printed sheet on said planar surface of said mounting board.

9. The signage apparatus recited in claim 5 wherein said mounting board is translucent for passing light entering from a rear surface of said mounting board.

10. The signage apparatus recited in claim 5 further comprising a transparent protective cover sheet for overlying said printed sheets releasibly affixed to said mounting board.

11. A readily modifiable signage apparatus comprising:

a mounting board having a substantially ace for receiving a printed sheet thereon;

a plurality of printed sheets for being releasibly affixed to said mounting board, each of said printed sheets and said mounting board having corresponding magnetic attraction devices affixed at selected locations for retaining at least one of said printed sheets on said planar surface in a precisely aligned position and for selective removal of one said printed sheet for replacement by another said printed sheet, said magnetic attraction devices being located within recess holes in said mounting board;

wherein at least one of said printed sheets comprises a price carrier affixed on a front surface of said at least one printed sheet, said price carrier having a plurality of accessible pockets for receiving selected price indicia members depending upon the current price of a product shown on said printed sheet.

12. A readily modifiable signage apparatus comprising:

a mounting board having a substantially planar surface for receiving a printed sheet thereon;

a plurality of printed sheets for being releasibly affixed to said mounting board, each of said printed sheets and said mounting board having corresponding magnetic attraction devices affixed at selected locations for retaining at least one of said printed sheets on said planar surface in a precisely aligned position and for selective removal of one said printed sheet for replacement by another said printed sheet, said magnetic attraction devices being located within recess holes in said mounting board;

further comprising at least one elongated edge member magnetically attached to said mounting board in overlapping relation to at least one of said printed sheets.

13. The signage apparatus recited in claim 12 wherein said elongated edge member affixes a pair of half sheets to said mounting board.

14. The signage apparatus recited in claim 13 wherein said half sheets overlap one another along at least one common edge.

15. A method of modifying a sign; the method comprising the steps of:

a) providing a plurality of printed sheets and a mounting board having at least one planar area for receiving at least one of said printed sheets;

b) affixing magnetic attraction devices directly to both printed sheets and said mounting board so that each said printed sheet will be positioned precisely in contiguous relation with said planar area when attached for magnetic attraction with said mounting board;

c) affixing a first printed sheet on said mounting board in said planar area so that said first sheet is held in place by said magnetic attraction devices with said first sheet in contiguous planar contact with said mounting board;

d) pulling said first printed sheet away from said mounting board with sufficient force to overcome said magnetic attraction devices; and e) affixing a second printed sheet on said mounting board in said planar area in place of said first sheet so that said second sheet is held in place by said magnetic attraction devices with said second sheet in contiguous planar contact with said mounting board;

further comprising the step of:

f) affixing a price carrier to at least one of said printed sheets on a front surface of said at least one printed sheet and providing a set of number members for selective insertion into said price carrier to indicate a price of a product referred to on said at least one printed sheet.

16. The method recited in claim 15 wherein step b) comprises the steps of attaching a respective metal member to said printed sheets and attaching a magnet to said mounting board and forming an aperture on said mounting board for receiving said magnet in substantial contact with said metal surface.

* * * * *